United States Patent [19]

Cowell et al.

[11] Patent Number: 4,483,027

[45] Date of Patent: Nov. 20, 1984

[54] FOLDABLE BUNK BED ASSEMBLY

[75] Inventors: James W. Cowell, Clearwater; James E. Anderson, St. Petersburg, both of Fla.

[73] Assignees: James A. Abdoney; Michael L. Thorpe, both of Tampa, Fla.

[21] Appl. No.: 387,972

[22] Filed: Jun. 14, 1982

[51] Int. Cl.[3] ..... A47C 19/06

[52] U.S. Cl. ..... 5/136; 5/164 R; 5/9 R; 5/159 R

[58] Field of Search ..... 5/8, 9 R, 9 B, 133, 5/136, 137, 159 R, 169 R, 164 C, 164 E, 171, 313 R

[56] References Cited

U.S. PATENT DOCUMENTS

| | | | |
|---|---|---|---|
| 777,284 | 12/1904 | Fuller | 5/9 R |
| 1,518,346 | 12/1924 | Murphy | 5/313 R |
| 1,815,358 | 7/1931 | Manville | 5/164 C |
| 2,257,625 | 9/1941 | Thomas | 5/136 |

FOREIGN PATENT DOCUMENTS

| | | | |
|---|---|---|---|
| 1107544 | 4/1961 | Fed. Rep. of Germany | 5/164 R |
| 1177779 | 9/1964 | Fed. Rep. of Germany | 5/9 R |
| 1269282 | 7/1961 | France | 5/9 R |
| 639020 | 5/1962 | Italy | 5/9 R |

*Primary Examiner*—Alexander Grosz
*Assistant Examiner*—Michael F. Trettel
*Attorney, Agent, or Firm*—Frijouf, Rust & Pyle

[57] ABSTRACT

A foldable bunk bed assembly is disclosed including an upper and lower bed assembly that can be opened independently. The upper bed assembly includes a leg assembly which includes at least one rung to facilitate climbing into the upper bed assembly. Also included are biasing means to aid in the opening and closing of the upper bed assembly.

7 Claims, 12 Drawing Figures

FIG. 1
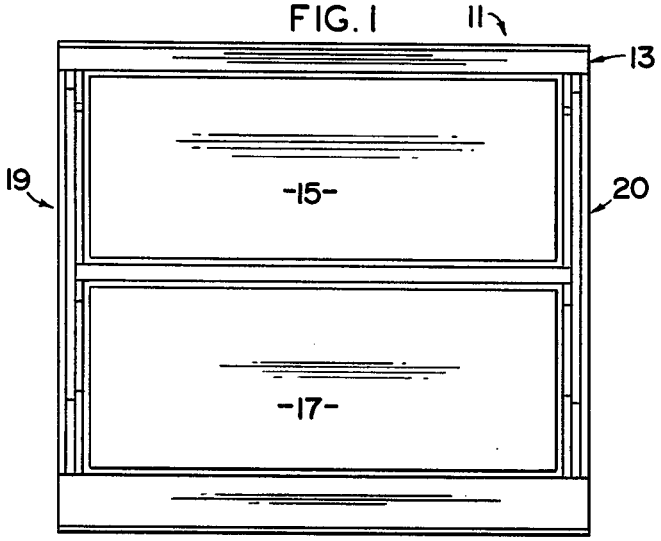
FIG. 2
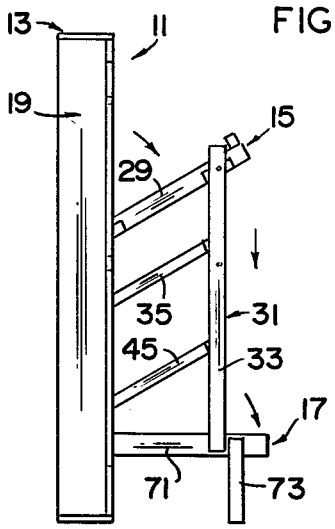
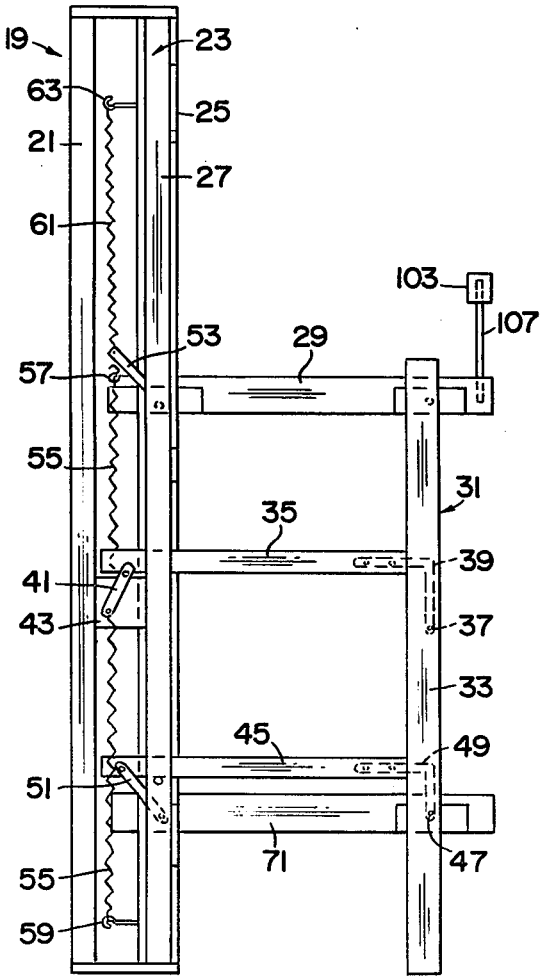
FIG. 3
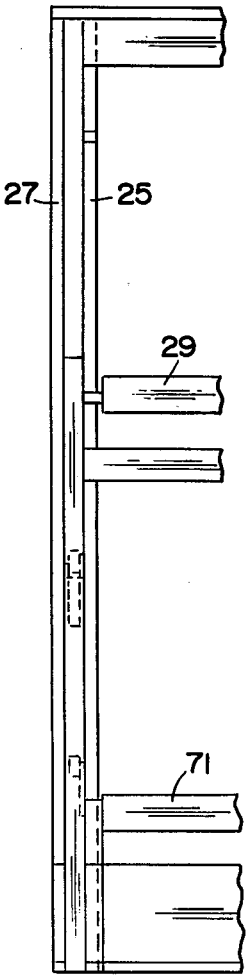
FIG. 4
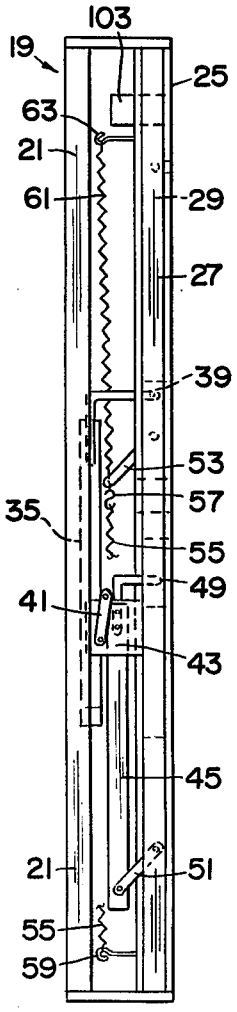
FIG. 5

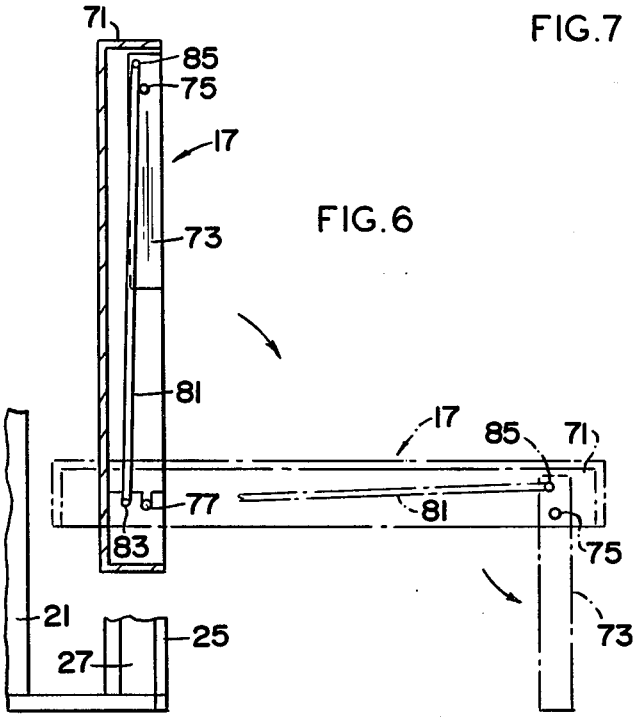
FIG. 6
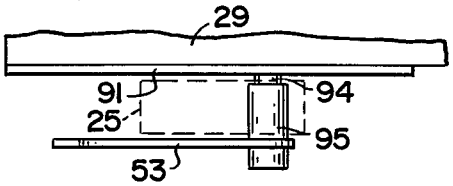
FIG. 7
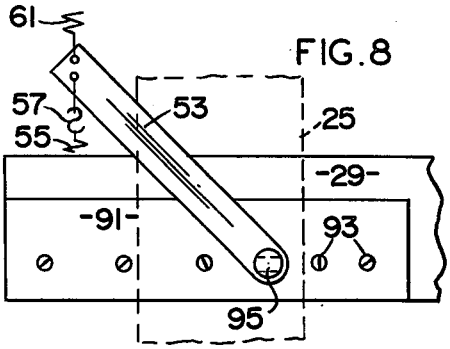
FIG. 8
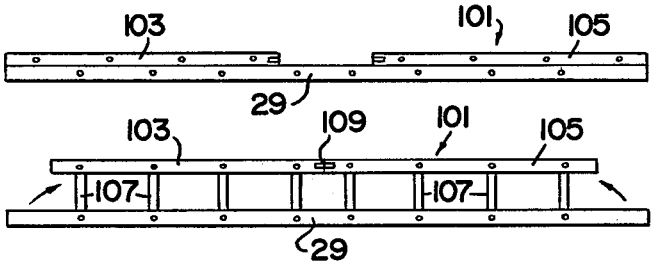
FIG. 10
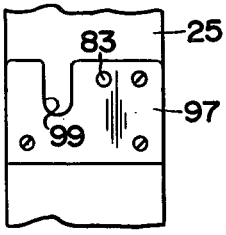
FIG. 9
FIG. 11
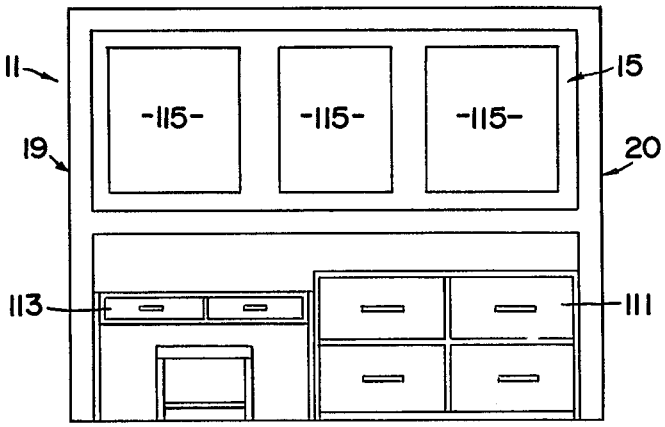
FIG. 12

FOLDABLE BUNK BED ASSEMBLY

BACKGROUND OF THE INVENTION

1. Field of the Invention

This invention relates to wall beds in general and more particularly to a foldable bunk bed assembly, including upper and lower bed assemblies which can be independently opened and closed.

2. Description of the Prior Art

Numerous patents have been issued upon wall bed devices, for example, U.S. Pat. No. 24,457 (Hopeman); U.S. Pat. No. 49,992, (Pullman); U.S. Pat. No. 580,278 (Hastings); U.S. Pat. No. 695,324 (Montague); U.S. Pat. No. 1,007,569 (Murphy); U.S. Pat. No. 1,740,183 (Lenney); U.S. Pat. No. 2,224,727 (Friede); U.S. Pat. No. 2,257,625 (Thomas); U.S. Pat. No. 2,528,307 (Heney); U.S. Pat. No. 2,634,433 (Woller); U.S. Pat. No. 2,637,856 (Woller); U.S. Pat. No. 2,650,370 (Cudini); U.S. Pat. No. 2,652,572 (Hopeman); U.S. Pat. No. 2,671,230 (Potter); U.S. Pat. No. 2,705,331 (Cone); U.S. Pat. No. 2,870,459 (Zabielski); U.S. Pat. No. 2,888,687 (Lindsey); U.S. Pat. No. 2,953,792 (Fleischer); U.S. Pat. No. 3,316,563 (Vogel); U.S. Pat. No. 3,755,832 (Bennett); and U.S. Pat. No.3,877,086 (Bue). These patents generally disclose wall units, including two beds hinged to move between respective closed and open positions, including simple pivoting connections for the two beds. The reference failed to disclose or suggest totally independent operation of each of the two bed units. The prior art also fails to disclose the use of legs for the upper bed in combination with the main support frame of the entire unit to provide a ladder-type device to the upper bed if lowered. The references also fail to disclose the spring-assisted mechanisms for extending the support legs and rungs of the upper bed assembly.

SUMMARY OF THE INVENTION

The foldable bunk bed assembly of the present invention is characterized by a frame having a pair of lateral post assemblies to which a first bed frame is pivotally coupled. A foldable leg is coupled to the bed frame, and at least one rung is pivotally and displaceably coupled to the leg and to the lateral post assembly. More specifically, the invention also includes a second bed assembly that can be lowered independently of the first bed assembly. Another more specific embodiment of the invention includes biasing means to help the user in raising and lowering the upper bed assembly.

Further features of the invention include means for pivotally and displaceably coupling the rung to the leg and to the lateral post assemblies so that the leg and the rungs can be folded compactly, when the upper bed assembly is raised.

BRIEF DESCRIPTION OF THE DRAWINGS

Further details are explained below with the help of the examples illustrated in the attached drawings in which:

FIG. 1 is a front view of the foldable bunk bed assembly of the present invention;

FIG. 2 is a side view of the foldable bunk bed assembly with the lower bed frame in the lowered position and the upper bed frame in a partially lowered position.

FIG. 3 is a partially cut away view of the bunk bed assembly with the upper and lower bed frames in the lowered position;

FIG. 4 is a front view of the lateral post assembly illustrated in FIG. 3;

FIG. 5 is a partially cut away side view of the foldable bunk bed assembly with the upper and lower bed frames in a closed position;

FIG. 6 is a side view of the lower bed assemblies;

FIG. 7 is a top view of the tensioning members;

FIG. 8 is a side view of the tensioning members of FIG. 7;

FIG. 9 is a side view of the fulcrum plate used in conjunction with the invention;

FIG. 10 is a front view of a rail assembly in the down position;

FIG. 11 is a front view of a railing assembly in the up position; and

FIG. 12 is a front view of a foldable bunk bed assembly used in conjunction with outer furniture.

Similar reference characters refer to similar parts throughout the several views of the drawings.

DETAILED DESCRIPTION

Illustrated in FIGS. 1 and 2 is a foldable bunk bed assembly 11 of the present invention. A foldable bunk bed assembly 11 includes a frame 13, an upper bed assembly 15 and a lower bed assembly 17. The frame 13 includes a pair of lateral post assemblies 19 and 20 each of which as illustrated in FIGS. 3–5, include an inner vertical post 21 and an outer vertical post assembly 23. The outer vertical post assembly 23 includes an interior beam 25 (best seen in FIG. 4) and an exterior beam 27.

The upper bed assembly 15 includes a rectangular bed frame 29 pivotally coupled at its proximate end to the interior beam 25; and pivotally coupled at its distal end to a leg assembly 31. The leg assembly 31 includes a pivotable leg 33 pivotally coupled at its upper end to the distal end of the regular frame 29. The leg assembly 31 also includes an upper rung 35 which is pivotally coupled to the foldable leg 33 at upper rung pivot point 37 (shown in FIG. 3) by means of an L-shaped member 39. The L-shaped member 39 is rigidly attached to upper rung 35 and pivotally attached to the foldable leg 33 at the upper rung pivot point 37. The other end of the upper rung 35 is coupled to the frame 13 by means of a pivoting member 41. Pivoting member 41 is a rectangular bar rotatingly coupled to a block 43 which is attached to the inner vertical post 21 and to the outer vertical post assembly 23. The pivoting member 41 is also pivotally attached to the rung 35. The leg assembly 31 also includes a lower rung 45 pivotally attached to pivotable leg 33 at a lower rung pivot point 47. The attachment is achieved by a second L-shaped member 49 secured to the lower rung 45 and pivotally attached to the pivotable leg 33 at lower rung pivot point 47. Lower rung 45 is also coupled at one end to the lower rung 45, and pivotally copuled at the other end to the outer vertical post assembly 23.

The upper bed assembly 15 also includes a tensioning member 53 which is rigidly coupled to the upper bed frame 29. The tensioning member 53 is attached to a first tensioning spring 55 by a connecting link 57. The tensioning spring is secured to the bottom of the outer vertical post assembly 23 by means of an eyebolt 59. The tensioning member 53 may also be connected to a second tensioning spring 61 which is secured to the top portion of the outer vertical post assembly 23 by means of a second eyebolt 63.

The utility of the upper bed assembly heretofore described can be appreciated from FIG. 3 and FIG. 5 which illustrate the upper bed assembly 15 in the open position and in the closed position respectively. The upper bed assembly 15 can be folded so that the pivotable leg 33 is inserted between the interior beam 25 and exterior beam 27 of the outer vertical post assembly 23. The rectangular bed frame 29 folds upwardly into the frame 13 while the rungs 35 and 45 fold into the space between the inner vertical post 21 and the outer vertical post assembly 23 as seen in the view of FIG. 5. The tensioning spring 61 and 55 can be adjusted so that a sufficient tensioning force is exerted on the tensioning member 53 so that a slight push on the outer edge of the rectangular bed frame 29 will result in the folding or unfolding of the upper bed assembly 15. This can be accomplished by arranging the springs 55 and 61 so that one is extended when the upper bed frame 29 is in a vertical position and conversely the other spring is extended when the upper bed frame 29 is in a horizontal position. The upper bed assembly 15 can therefore be opened or closed independently of the lower bed assembly 17 and in addition, is automatically provided with a pair of rungs 35 and 45 for ease in climbing into the upper bed frame 29.

Illustrated in FIG. 6 is the lower bed assembly 17 which includes a lower rectangular bed frame 71 which is pivotally attached to the outer vertical post assembly 23. A lower leg 73 is pivotally attached to the lower rectangular bed frame 71 at pivot point 75 and can fold inwardly for easy storage as shown in FIG. 6. The lower rectangular bed frame 71 pivots about lower frame pivot point 77. A bar 81 is pivotally attached through fulcrum plate 97 to interior beam 25 as shown at first bar pivot point 83. The bar 81 is also pivotally connected to the lower leg 73 at pivot point 85 located above the pivot point 75 on the lower leg 73. The action of the bar 81 as it pivots about member 83 provides a pulling function at pivot point 85 on lower leg 73. This results in the unfolding of the leg 73 when the lower rectangular bed frame 71 is opened, (displaced to a horizontal position) and alternatively a closing function when the lower rectangular bed frame 71 is closed (displaced to a vertical position).

Illustrated in FIGS. 7 and 8 are the tensioning member 53 and the tensioning springs 55 and 61, referred to above. The tensioning member 53 is a bar which is attached to a plate 91 disposed on the upper rectangular bed frame 29. The plate 91 is secured to the bed frame 29 by a plurality of screws 93. Plate 91 includes a shaft 94 which rotates within a bearing sleeve 95 and receives the tensioning member 53 thereon. The tensioning springs 55 and 61 provide a biasing force which aids the user in lifting and dropping the upper bed assembly 15.

Illustrated in FIG. 9 is a fulcrum plate 97 which is used as the means for pivotally attaching the bedframe 71 to the interior beam 25 of the outer vertical post assembly 23. The fulcrum plate 97 is a rectangular plate member having a U-shaped slot 99.

With further regard to the views of FIGS. 7 and 8, and the pivoting assembly for the upper bed frame 29, the shaft 94 rotates within the fixed bearing sleeve 95 and receives tensioning member 53 on the distal end thereof. As shown in broken lines in the views of FIGS. 7 and 8, the pivoting assembly for upper bed frame 29 is mounted through interior beam 25 and pivots thereabout, as shown in FIG. 2.

Illustrated in FIGS. 10 and 11 is a rail mechanism 101 which can be used in conjunction with the upper rectangular bed frame 29. The rail mechanism 101 includes a pair of rails 103 and 105 which are pivotally coupled to the upper rectangular bed frame 29 by means of a plurality of bars 107. A latch 109 is provided to lock rails 103 and 105 in place when the rails are upwardly disposed as illustrated in FIG. 11.

Illustrated in FIG. 12 is an example of how the upper bed assembly 15 can be used in conjunction with other furnishing such as a chest 111 or a desk 113. The upper bed assembly 15 can be disguised by the use of a plurality of mirrors 115 or by use of some other decorative attachments.

It will thus be seen that the objects set forth above, among those made apparent from the preceeding description, are efficiently attained and, since certain changes may be made in the above construction without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention herein described, and all statements of the scope of the invention which, as a matter of language, might be said to fall therebetween.

Now that the invention has been described, what is claimed is:

1. A wall bed comprising:

a pair of lateral post assemblies;

a first bed frame disposed with its proximate end adjacent to and pivotally coupled to said lateral post assemblies; and a pair of leg assemblies coupled to the distal end of said bed frame, each of said leg assemblies comprising:

a foldable leg pivotally coupled to the distal end of said bed frame;

at least one rung having its proximate end disposed adjacent one of said lateral post assemblies;

first means for pivotally and displaceably coupling the distal end of said rung to said leg comprising an L-shaped member pivotally coupled at one end to said leg and secured at the other end to said rung; and second means for pivotally and displaceably coupling the proximate end of said rung to one of said lateral post assemblies, whereby rotation of the bed frame results in the rotation of the leg with respect to the bed frame, the rotation and displacement of the rung with respect to the leg and the rotating and displacement of the rung with respect to the lateral post assemblies.

2. The wall bed of claim 1 wherein said second means for pivotally and displaceably coupling comprises a bar pivotally coupled to said rung and pivotally coupled to one of said lateral post assemblies.

3. The wall bed of claim 1 further comprising:

a second bed frame disposed below said first bed frame, said second bed frame having its proximate end disposed adjacent to and pivotally coupled to said lateral post assemblies; and a pair of second leg assemblies independent of said first leg assembly, each of said second leg assemblies comprising:

a second leg pivotally coupled to the distal end of said second bed frame; and means for folding said second leg when the second bed frame is rotated.

4. The wall bed of claim 1 wherein said at least one rung comprises:

an upper rung having its proximate end disposed adjacent one of said lateral post assemblies;

first upper means for pivotally and displaceably coupling the distal end of said upper rung to said leg; p1 second upper means for pivotally and displaceably coupling the proximate end of said upper rung to one of said lateral post assemblies;

a lower rung disposed below said upper rung and having a proximate end disposed adjacent one of said lateral post assemblies;

first lower means for pivotally and displaceably coupling the distal end of said lower rung to said leg; and second lower means for pivotally and displaceable coupling the proximate end of said lower rung to one of said lateral post assemblies.

5. The wall bed of claim 1 further comprising:

spring means coupled to said first bed frame for assisting the pivoting of said first bed frame.

6. The wall bed of claim 5 wherein said spring means comprises:

a bar rigidly attached to the proximate end of said first bed frame;

a first spring having one end attached to the top of said bar and the other end attached to the top of one of said lateral post assemblies; and a second spring having one end attached to the bottom of said bar and the other end attached to the bottom of said lateral post assembly, said first and second springs having a length and being disposed in such a way that one of said springs is stretched when the first bed frame is in a horizontal position and the other of said springs is stretched when the bed frame is in a vertical position.

7. In a wall bed of the type having a vertical supporting structure, an upper and a lower bed structure and means for pivotally mounting said bed frame structures on said supporting structure the improvement comprising:

a pair of legs pivotally secured to the upper bed;

at least a pair of rungs;

means comprising a pair of L-shaped members each one of said pair being pivotally coupled at one end to a leg and secured at the other end to a rung for pivotally and displaceably coupling each of said pair of rungs to a corresponding one of said legs; and means for pivotally and displaceable coupling each of said pairs of rungs to the vertical supporting structure.

* * * * *